US008242347B2

(12) United States Patent
Ikeya et al.

(10) Patent No.: US 8,242,347 B2
(45) Date of Patent: Aug. 14, 2012

(54) PEDAL OUTPUT CONVERSION APPARATUS AND METHOD

(75) Inventors: Tadahiko Ikeya, Hamamatsu (JP); Daisuke Suzuki, Hamamatsu (JP); Takeshi Komano, Iwata (JP)

(73) Assignee: Yamaha Corporation (JP)

( * ) Notice: Subject to any disclaimer, the term of this patent is extended or adjusted under 35 U.S.C. 154(b) by 195 days.

(21) Appl. No.: 12/684,432

(22) Filed: Jan. 8, 2010

(65) Prior Publication Data

US 2010/0175544 A1 Jul. 15, 2010

(30) Foreign Application Priority Data

Jan. 9, 2009 (JP) ..... 2009-003796

(51) Int. Cl.
*G10H 1/32* (2006.01)
*G10H 5/00* (2006.01)

(52) U.S. Cl. ..... 84/746

(58) Field of Classification Search ..... 84/721, 84/744, 225, 426, 746
See application file for complete search history.

(56) References Cited

U.S. PATENT DOCUMENTS

| | | | | |
|---|---|---|---|---|
| 5,131,306 | A * | 7/1992 | Yamamoto | 84/19 |
| 5,429,092 | A * | 7/1995 | Kamei | 123/399 |
| 5,878,359 | A * | 3/1999 | Takeda | 701/34 |
| 7,332,670 | B2 * | 2/2008 | Fujiwara et al. | 84/744 |
| 7,851,690 | B1 * | 12/2010 | Stahnke | 84/723 |

FOREIGN PATENT DOCUMENTS

| | | |
|---|---|---|
| JP | 7-036460 A | 2/1995 |
| JP | 2002-091447 A | 3/2002 |

* cited by examiner

*Primary Examiner* — Jeffrey Donels
(74) *Attorney, Agent, or Firm* — Rossi, Kimms & McDowell LLP

(57) ABSTRACT

Detection outputs value based on outputs of a sensor for detecting a depressed position of a pedal are input via the input section; meanwhile, a detection output value corresponding to a non-depressed state of the pedal is set as an offset value. The detection output value, input via the input section, is adjusted with the offset value, so as to provide an adjusted detection output value corresponding to an actual depressed amount of the pedal. The adjusted detection output value is converted into a control value corresponding to the depressed amount of the pedal. Thus, the offset value is variably set in accordance with an individual difference, aging, etc. of the pedal, so that the detection output value adjusted with such an offset value can be a value having unevenness in the sensor outputs, which may have occurred due to an individual difference, aging, etc. of the pedal, automatically compensated.

11 Claims, 3 Drawing Sheets

PEDAL OUTPUT CONVERSION APPARATUS AND METHOD

BACKGROUND

The present invention relates to pedal output conversion apparatus and methods for outputting a control value (tone control information) pertaining to tone control, such as tone volume value control, in response to operation of a pedal of a pedal operator unit, and more particularly to a technique for controlling a tone with unevenness or variation in a control value, which may occur due to individual differences, aging, etc. of the pedal operator unit, appropriately compensated for.

Heretofore, in electronic keyboard instruments, such as electronic pianos, a pedal operator unit (i.e., pedal-type operating member unit) is popularly employed as a controller for, for example, controlling an attenuation amount of a tone volume or lowering a tone volume and softening a tone color. In some cases, the pedal operator unit is used to impart a continuous pitch-bend effect to a tone as a special effect not achievable by an acoustic piano. One example of such apparatus is disclosed in Japanese Patent Application Laid-open Publication No. HEI-07-036460 (hereinafter referred to as "the patent literature").

In the conventionally-known apparatus as disclosed in the patent literature, to further approximate the operational feeling of a natural musical instrument, such as a piano, one or more pedals P of the pedal operator unit U are supported by respective springs B, as shown in FIG. 5. Thus, as a user reduces his or her depressing force on any one of the pedals P, the pedal P resiliently returns to a predetermined position, defined by a stopper T (fixed to an outer casing or the like and having a shock absorbing member like felt F), by a biasing force of the spring B that acts in response to user's depression of the pedal P. In other words, the stopper T determines an upper limit of the movable range of the pedal P, while the spring B determines a lower limit of the movable range of the pedal P. An angular position at which the pedal P is located within a movable range of the pedal P (this angle will hereinafter be referred to as "depressed angle" or "depressed position" for convenience of description) can be taken out as an analog value corresponding to a resistance value of a variable resistor K. Tone control information representing a digital control value, for example, in a numerical value range of 0-255 is determined on the basis of the taken-out analog value (i.e., output value in the movable range). Such arrangements allow a tone to be controlled in a continuous or multi-step fashion in response to user's operation of the pedal.

However, with the conventionally-known apparatus, the resistance value (output value) of the variable resistor K responsive to the depressed angle of the pedal P and hence the control value can undesirable vary because individual differences of the pedal operator unit U may result from mounted conditions of a multiplicity of component parts, such as the pedals P, variable resistors K, stoppers T, springs B, etc., constituting the pedal operator unit U and because aging of the component parts, such as deterioration of the felts F, weakening of the springs B and deviation of relative mounted positions movable of the individual component parts. Namely, due to the individual differences, aging, etc, of the pedal operator unit U, the control value responsive to the depressed angle of the pedal P would undesirably vary or become uneven even for the same depressed amount, in which case it would be extremely difficult for a user (human player) to perform appropriate tone control by depressing any desired one of the pedals P with an always constant operational feeling (depressed amount) without being adversely influenced by individual differences, aging etc. of the pedal operator unit U.

Thus, in order to prevent variation or unevenness from occurring in the control values due to individual differences, aging, etc. of the pedal operator unit U, the conventionally-known apparatus is constructed to appropriately adjust an effective range within which to output control values (i.e., effective control value outputting range) without being influenced by the individual differences, aging etc. of the pedal operator unit U, by previously providing, in the movable range of the pedal P, play or idle regions as shown in FIG. 5 where output of the control value is inhibited, The provision of such idle regions may be advantageous in that the wider the idle regions, the wider the apparatus can cope with the individual differences, aging, etc. of the pedal operator unit U; however, if the idle regions are too wide, then there would be presented the problem that the effective pedal operating range is considerably limited so that response to user's pedal depressing operation is sacrificed and thus a direct operational feeling is lost, which would make it difficult for the user to operate the pedal.

Another conceivable approach may be to assemble a pedal operator unit U using component parts formed of heavy-duty members or to design a heavy-duty pedal operator unit U capable of enduring aging. However, such an approach would undesirably increase manufacturing cost of the pedal operator unit U.

Further, the prior art apparatus can not quickly deal with a situation where there has occurred an inconvenience that supposed control values can not be output during a performance due to individual differences, aging, etc. of the pedal operator unit U.

SUMMARY OF THE INVENTION

In view of the foregoing, it is an object of the present invention to provide an improved pedal output conversion apparatus and method which, with a simple construction, can output an appropriate control value (tone control information) with unevenness or variation, which may occur due to individual differences, aging, etc. of a pedal operator unit, automatically compensated for, in such a manner that a user (human player) can perform appropriate tone control by being allowed to depress any desired pedal with an always constant operational feeling and without being adversely influenced by the individual differences, aging etc. of the pedal operator unit.

In order to accomplish the above-mentioned object, the present invention provides an improved pedal output conversion apparatus, which comprises: an input section which inputs, to the pedal output conversion apparatus, a detection output value based on an output of a sensor for detecting a depressed position of a pedal; an offset value setting section which sets, as an offset value, a detection output value outputted by the sensor and corresponding to a non-depressed state of the pedal; an adjustment section which adjusts the detection output value, inputted via the input section, with the offset value and thereby provides an adjusted detection output value corresponding to an actual depressed amount of the pedal; and a conversion section which converts the adjusted detection output value into a control value corresponding to the depressed amount of the pedal.

According to the present invention, each detection output value based on an output of the sensor for detecting a depressed position of the pedal is input via the input section, during which time a detection output value output by the sensor and corresponding to the non-depressed state of the pedal is set as an offset value. The detection output value, input via the input section, is adjusted with the offset value, so as to provide an adjusted detection output value corresponding to an actual depressed amount of the pedal. The adjusted detection output value is converted into a control value corresponding to the depressed amount of the pedal. Thus, in the present invention, the offset value itself is variably set in accordance with an individual difference, aging, etc. of the pedal, so that the detection output value adjusted with such an offset value can be a value having variation or unevenness in the sensor outputs, which may have occurred due to an individual difference, aging, etc. of the pedal, automatically appropriately compensated for, i.e. can be sort of a value having been normalized on the basis of the non-depressed state of the pedal. Because a given control value is provided by converting the adjusted detection output value, there is no longer a need to secure wide play or idle regions of the pedal as in the conventionally-known apparatus for providing given control values responsive to a changing stepped amount of the pedal; thus, the present invention can expand the effective control value outputting range. In addition, a user to can perform appropriate control of tones etc. by being allowed to depress any desired pedal with a constant operational feeling (depressed amount) and without being adversely influenced by the individual difference of the pedal.

The present invention may be constructed and implemented not only as the apparatus invention as discussed above but also as a method invention. Also, the present invention may be arranged and implemented as a software program for execution by a processor such as a computer or DSP, as well as a storage medium storing such a software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

Figure 1:
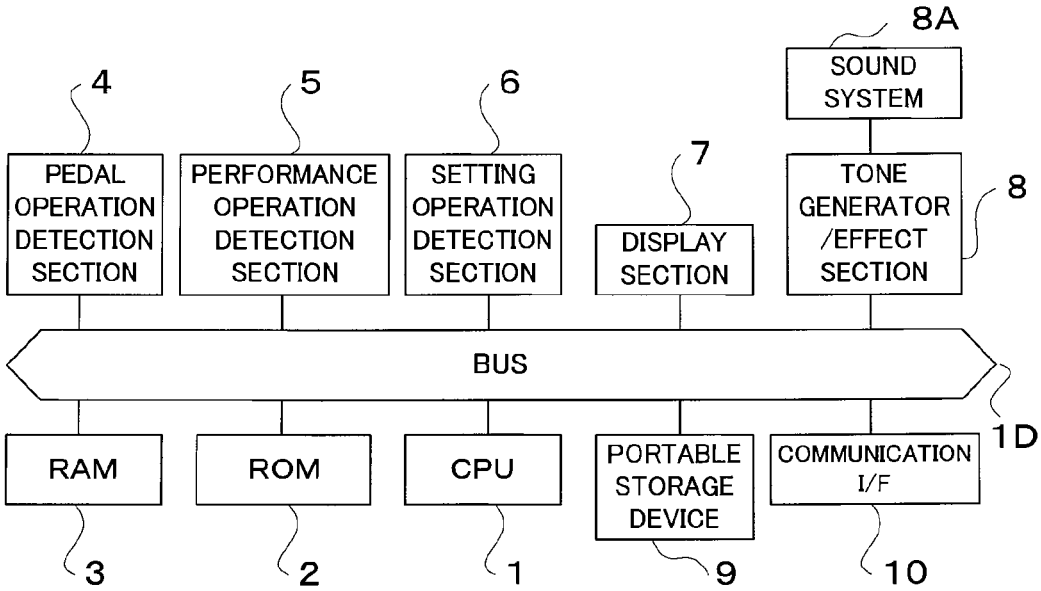
FIG. 1 is a block diagram showing an embodiment of a general hardware setup of an electronic musical instrument to which is applied a pedal output conversion apparatus in accordance with an embodiment of the present invention.

FIG. 1 is a block diagram showing an embodiment of a general hardware setup of an electronic musical instrument to which is applied a pedal output conversion apparatus in accordance with an embodiment of the present invention. The electronic musical instrument of FIG. 1 is controlled by a microcomputer including a microprocessor unit (CPU) 1, a read-only memory (ROM) 2 and a random access memory (RAM) 3. The CPU 1 controls operation of the entire electronic musical instrument. To the CPU 1 are connected, via a communication bus (e.g., data and address bus) 1D, the ROM 2, the RAM 3, a pedal operation detection section 4, a performance operation detection section 5, a setting operation detection section 6, a display section 7, a tone generator/effect section 8, a portable storage device 9 and a communication interface (IF) 10.

The ROM 2 stores therein various programs for execution by the CPU 1 and various data for reference by the CPU 1. The RAM 3 is used as a working memory for temporarily storing various data generated as the CPU 1 executes predetermined programs, as a memory for temporarily storing a currently-executed program and data related to the currently-executed program, and for various other purposes. Predetermined address regions of the RAM 3 are allocated to various functions and used as various registers, flags, tables, memories, etc.

Figure 5:
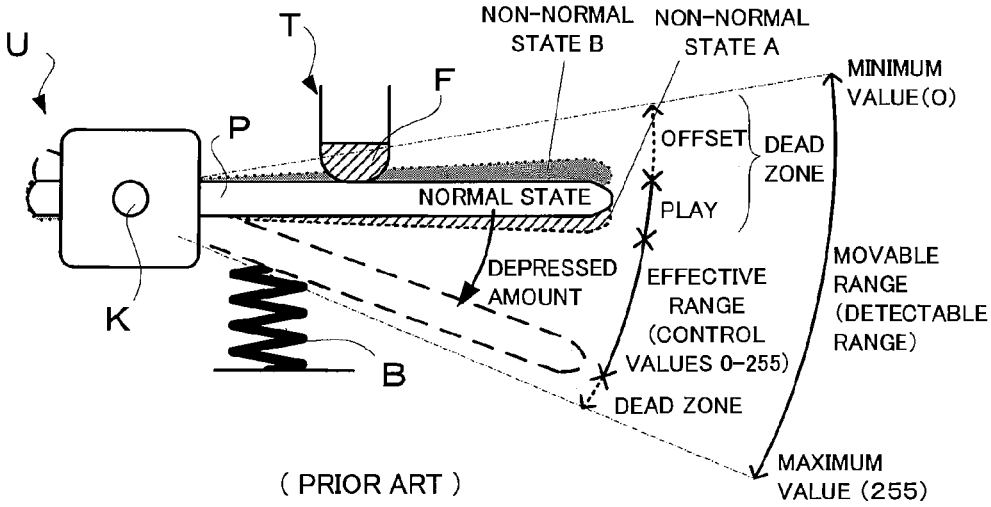
( PRIOR ART ) F I G. 5
FIG. 5 is a view showing an example general construction of a conventionally-known pedal operator unit.

The pedal operation detection section (i.e., detected data input section) 4 is connected to a pedal operator unit U (not shown in FIG. 1) of the well-known type including one or more pedals P as shown in FIG. 5. The following describe only one of the pedals P because the pedals P are identical to each other in construction and behavior. The pedal operation detection section 4 is, for example, in the form of an A/D converter, which acquires output values, corresponding to a changing depressed angle of the pedal P, sequentially generated from a variable resistor (i.e., sensor) K in response to depressing operation of the pedal P and thereby generates detection output values, for example, in a range of 0 to 255. As will be later described in detail, each of the detection output values is delivered from the pedal operation detection section 4 to the CPU 1 so that the CPU 1 determines a control value (tone control information) by referencing a conversion table (FIG. 2), prestored in the ROM 2, on the basis of the delivered detection output value. The performance operation detection section 5 generates detection outputs by detecting depression and release of individual keys of a performance operator unit (not shown), such as a keyboard, having a plurality of keys for selecting a pitch of each tone to be generated.

Figure 2:
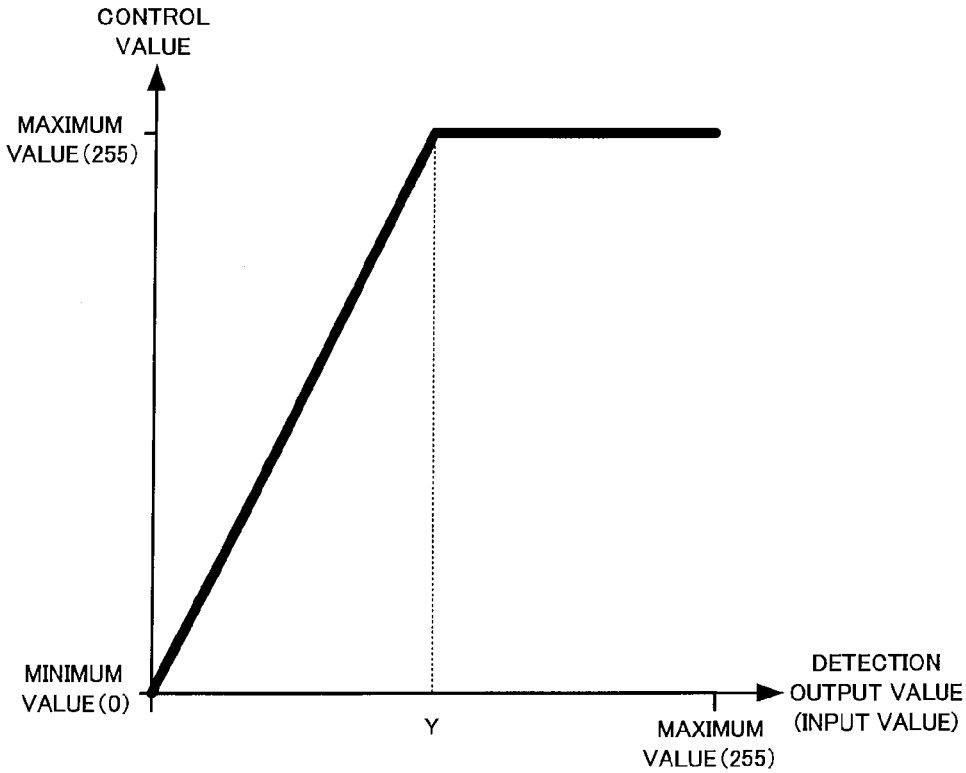
FIG. 2 is a graph showing an example of data stored in a conversion table employed in the embodiment.

The following describe the conversion table prestored in the ROM 2 to be referenced on the basis of a detection output value from the pedal operation detection section 4 when a control value is to be determined. FIG. 2 is a graph illustratively showing an example of data stored in the conversion table, where the horizontal axis represents the detection output values (input values) input from the pedal operation detection section 4 while the vertical axis represents the control values output to a not-shown process at a succeeding stage (such as an effect impartment process). Although detailed description is omitted, the not-shown effect impartment processes etc. perform tone control processes, such as a process for imparting an effect to a tone signal, on the basis of the output control value.

In the illustrated example of FIG. 2, as the detection output value sequentially increases from the minimum value "0" to a predetermined value Y, the control value gradually increases from a minimum value "0" toward a maximum value "255" monotonously in a linear function. Then, after the control value reaches the maximum value "255", it remains at the maximum value "255" even if the detection output value sequentially increases from the predetermined value Y to the maximum value "255". The conversion table stores therein a list of control values determined in correspondence with individual detection output values as shown in the graph of FIG.

2, i.e. defines correspondency between the detection output values and the control values, in such a manner that the control value can be controlled successively on the basis of the detection output values successively generated from the pedal operation detection section 4.

Needless to say, the content of the conversion table is not limited to the correspondency as shown in the graph of FIG. 2, and it may be one defining correspondency between the detection output values and the control values such that the control value increases relative to the detection output value in a desired quadratic curve or in a multiple-curve fashion, or increases relative to the detection output value in a stepwise manner to permit multi-step control of a tone. As such a conversion table, a separate dedicated conversion table may be provided (prestored) per each of types of tone control parameters to be used for the pedal operator unit U, or a common conversion table may be provided (stored) per several of types of tone control parameters to be used for the pedal operator unit U.

Referring back to FIG. 1, a setting operation detection section 6 detects operating states of each of setting operating members (not shown) and outputs switch information, corresponding to the detected operating state, etc. to the CPU 1 via the data and address bus 1D. Examples of the setting operating members include switches for selecting music piece data to be performed, an accompaniment switch for executing an automatic accompaniment, switches for selecting, setting and controlling a tone pitch, color, effect, etc., and operating members for assigning various types of tone control parameters to the individual pedals P as objects of control. With different types of tone control parameters assigned to the individual pedals P, the pedals P can have different tone control functions, for example, as a half-damper pedal, pitch bend pedal, etc.

The display section 7 displays, on a display (not shown) in the form of a liquid crystal display (LCD) panel, CRT or the like, types of tone control parameters assignable to the individual pedals P and types of tone control parameters currently assigned to the pedals P. The display section 7 also displays, on the display, various screens (not shown), such as a screen displaying a list of data sets of music pieces capable of being performed and a musical score screen displaying a musical score of a music piece currently performed, various data stored in the ROM 2 and portable storage device 9, controlling states of the CPU 1, etc.

The tone generator/effect section 8, which is capable of simultaneously generating tone signals in a plurality of tone generation channels, receives performance information supplied via the data and address bus 1D, and generates tone signals by performing tone synthesis on the basis of the received performance information. The tone generator/effect section 8 can also impart effects to the tone signals to be generated, for example, on the basis of control values determined in accordance with detection output values generated from the pedal operation section 4. The tones signals generated by the tone generator/effect section 8 are audibly generated or sounded via a sound system 8A including an amplifier and speaker. The tone generator/effect section 8 and sound system 8A may be constructed in any desired conventionally-known manner. For example, the tone generator/effect section 8 may employ any desired tone synthesis method, such as the FM, PCM, physical model or format synthesis method. Further, the tone generator/effect section 8 may be implemented by either dedicated hardware or software processing performed by the CPU 1.

The portable storage device 9 may use any of various removable-type external recording media, such as a flexible disk (FD), compact disk (CD), magneto-optical disk (MO) and digital versatile disk (DVD). The portable storage device 9 stores therein various information, such as music piece data and various control programs to be executed by the CPU 1. In a case where a particular control program is not prestored in the ROM 2, the control program may be prestored in the portable storage device 9, so that, by reading the control program from the storage device 9 into the RAM 3, the CPU 1 is allowed to operate in exactly the same way as in the case where the particular control program is stored in the ROM 2.

The communication interface (I/F) 10 is an interface for communicating control programs, music piece data, etc. between the instant apparatus and not-shown external equipment. The communication interface 10 may be a MIDI interface, LAN, Internet, telephone line network or the like. It should be appreciated that the communication interface 10 may be of either or both of wired and wireless types.

In the aforementioned electronic musical instrument, the performance operation detection section 5, display section 7, tone generator/effect section 8, etc. need not be incorporated together within the body of the apparatus. For example, the above-mentioned components 5, 7, 8, etc. may be provided separately and interconnected via communication facilities such as a MIDI interface, various networks and/or the like.

Next, a description will be given about a "pedal output conversion process" performed in the instant embodiment for detecting a depressed angle (depressed position) of the pedal P and outputting a control value (tone control information) corresponding to the detected depressed angle of the pedal P, with reference to FIG. 3 that is a flow chart showing an example operational sequence of the "pedal output conversion process". The "pedal output conversion process", which is performed by the CPU 1, is started up, for example, a predetermined time (e.g., 160 msec. that is a time necessary for operation of the pedal operation detection section 4 to stabilize) after powering-on of the electronic musical instrument and then repetitively performed at predetermined time intervals of, for example, 10 msec. As apparent to a person skilled in the art, an initialization process is performed, upon powering-on of the electronic musical instrument, for initializing an initial execution determination flag, output storage buffer, other buffers, such as one for storing an offset value to be used in the process, variables, etc.

At step S1, a detection output value, for example, in the range of 0-255 corresponding to an output value of the variable resistor K is acquired from the pedal operation detection section 4. More specifically, the pedal operation detection section 4 detects a current depressed angle of the pedal P in a state being depressed or not being depressed by the user. More specifically, the state not being depressed by the user (depressed state) is any one of 1) a normal state where the pedal P remains stationary and neither deterioration of a felt F nor weakening of a spring B has occurred yet (i.e., an ideal state where the pedal P still remains unchanged from an initial design and factory default), 2) a non-normal state where the pedal P remains stationary and deterioration of the felt F and weakening of the spring B has occurred (i.e., a state deviated from the normal state), and 3) a vibrating state where the pedal P is spontaneously vibrating up and down quickly (i.e., "chattering") in the above-mentioned normal state or non-normal state (this vibration or "chattering" decreases with the passage of time). As will be later described, the instant embodiment is constructed to grasp, as an offset value, a depressed angle of the pedal P in the state not being depressed by the user and update this offset value as needed. With such an offset value, the instant embodiment can compensate for undesired variation in the depressed angle (detection output value) in the non-depressed state of the pedal P due to time variation, aging and individual difference of the pedal P. The pedal P is normally biased in one direction by the spring in such a manner that the pedal is displaced from an original rest position, in response to user's operation of the pedal, in an opposite direction from the one direction against the biasing force of the spring, and that, when the user's operation of the pedal is canceled, the pedal returns to the original rest position by the biasing force of the spring.

The instant embodiment will be described assuming that the detection output value increases as the depressed amount of the pedal P becomes greater.

At step S2, a determination is made as to whether the current execution of the pedal output conversion process is an initial execution of the process. The "initial execution of the process" means the first execution of the pedal output conversion process after the powering-on of the electronic musical instrument. The determination at step S2 is made by determining whether the initial execution determination flag, indicating whether or not the current execution of the pedal output conversion process is the initial execution of the process, is currently at a value "0" indicating the initial execution. If the current execution of the pedal output conversion process is the initial execution of the process as determined at step S2 (i.e., YES determination at step S2), the detection output value acquired from the pedal operation detection section 4 is set as the offset value at step S3, and then the pedal output conversion process is brought to an end. Namely, the depressed angle of the pedal P in an initial state immediately after the powering-on of the electronic musical instrument is set as the offset value. At that time, the initial execution determination flag is set at a value "1" indicating the current execution is not the initial execution.

Namely, the instant embodiment is provided with the initial execution determination flag for determining, at the time of setting the offset value for the first time immediately after the powering-on of the electronic musical instrument, whether or not the current execution of the pedal output conversion process is the initial execution of the process, and it sets, as the offset value, the detection output value acquired at the time of the initial execution (see steps S2 and S3).

If, on the other hand, the current execution of the pedal output conversion process is not the initial execution of the process as determined at step S2 (i.e., NO determination at step S2), a further determination is made, at step S4, as to whether the detection output value acquired from the pedal operation detection section 4 is greater than the offset value. If the detection output value acquired from the pedal operation detection section 4 is not greater than the offset value (i.e., NO determination at step S4), the acquired detection output value is stored into the output storage buffer at step S5. Namely, if the detection output value acquired from the pedal operation detection section 4 every predetermined execution time interval of the process is smaller than the offset value, the output storage buffer stores the detection output value. The detection output value thus stored in the output storage buffer is a candidate offset value that is likely to become a new offset value. This is because the detection output value acquired from the pedal operation detection section 4 in correspondence with the non-depressed state of the pedal P is supposed to be the smallest value. However, in the instant embodiment, a detection output value smaller than the offset value is not simply updated as a new offset value; instead, some particular arrangement is made for preventing erroneous updating of the offset value due to undershoot of the detection output value caused by unstable vibrations (chattering or minute vibrations) in the pedal-OFF or non-depressed state of the pedal.

At step S6, a determination is made as to whether the output storage buffer has currently stored therein a predetermined number of, e.g., four, detection output values acquired from the pedal operation detection section 4. When the predetermined number of (e.g., four) detection output values smaller than the current offset values have been output in succession from the pedal operation detection section 4, the output storage buffer is placed in a state having stored therein such predetermined number of (e.g., four) detection output values. If the output storage buffer does not have currently stored therein the predetermined number of (e.g., four) detection output values (NO determination at step S6), the process jumps to step S9. In this way, it is possible to eliminate any detection output value corresponding to undershoot caused by unstable vibrations (chattering or minute vibrations) in the non-depressed state of the pedal P. If, on the other hand, the output storage buffer has currently stored therein the predetermined number of detection output values (YES determination at step S6), the greatest of the currently stored detection output values is set as a new offset value to replace the current offset value at step S7. The reason why the current offset value is updated with the greatest of the detection output values currently stored in the output storage buffer is to allow the offset value to stably decrease to a suitable value when unstable vibrations (chattering or minute vibrations) have occurred in the non-depressed state of the pedal P. After that, the output storage buffer is cleared at step S8. At next step S9, a minimum control value ("0" in the illustrated example of FIG. 2) is output to a succeeding process (such as a not-shown effect impartment process) irrespective of the detection output value.

If, on the other hand, the detection output value acquired from the pedal operation detection section 4 is greater than the offset value (i.e., YES determination at step S4), the output storage buffer is cleared at step S10. That the detection output value acquired from the pedal operation detection section 4 is greater than the offset value means that the pedal P has been depressed or that "overshoot" has occurred due to unstable vibrations (chattering or minute vibrations) in the non-pressed state of the pedal, and the clearing of the output storage buffer is effected for discarding the offset-value updating content of the output storage buffer. Then, a difference between the acquired detection output value and the current (i.e., currently stored/updated) offset value is determined at step S11. Namely, the acquired detection output value is corrected or adjusted with the offset value. At step S12, a given play value is added to the difference determined at step S11 (more specifically, a fixed value corresponding to an angle pre-determined on the basis of the determined difference is subtracted from the determined difference), and then a key value (input value) is determined for the conversion table (FIG. 2) prestored in the ROM 2. The addition of the play value is a design option. At step S13, the conversion table is referenced in accordance with the determined key value. Then, at step S14, a control value obtained with reference to the conversion table is output to the succeeding process.

A description will be given specific examples of the "pedal output conversion process" with a view to facilitating the aforementioned "pedal output conversion process". Let it be assumed here that the various component parts are provided so that a detection output value "30" is output from the pedal operation detection section 4 when the pedal P is in the normal state, and that an angle corresponding to a detection output value "10" (fixed value) is secured in advance as the play value. The following describe the specific examples with reference to FIG. 5 and FIG. 4 that illustrates a graph showing example control values to be output in response to execution of the pedal output conversion process.

EXAMPLE 1

The pedal output conversion process is described in relation to a case where the pedal P is in the normal state ("Normal State" in FIG. 5). In the initial execution of the pedal output conversion process, the current detection value is set directly as the offset value (see step S3 of FIG. 3); thus, in this case, "30" is set as the offset value. Once the pedal P is depressed by the user, a detection output value corresponding to a depressed angle of the pedal P is output from the pedal operation detection section 4 (step S1 of FIG. 3). The detection output value output at that time is of course a greater value (e.g., "100") than the detection output value output before the depression of the pedal P; namely, it is greater than the offset value "30". Thus, a difference between the detection output value "100" and the offset value "30" is calculated as "70" (i.e., 100−30=70) (step S11 of FIG. 3). Then, the play value is added to the difference "30", so that a key value "60" is obtained (i.e., 70−10=60). On the basis of the key value "60", a control value is output with reference to the original (pre-stored) conversion table shown in FIG. 4 (steps S12-S14).

Thus, although the detection output value corresponding to operation of the user (i.e., corresponding to a depressed angle) is "100", a control value (N) corresponding to the input value "60" is output from the original conversion table instead of a control value (L) corresponding to the input value "100" being output from the original conversion table. Namely, a detection output value "40" corresponding to one of two dead zones which consists of the offset value and the play value (i.e., 30+10=40) is determined, and a control value corresponding to an amount (angle) through which the user has actually depressed the pedal P is determined using the detection output value "40" as a base or reference (i.e., a minimum value of an effective range). Thus, even if the detection output value corresponding to operation of the user (depressed angle) is "100", the detection output value corresponding to the amount (angle) through which the user has actually depressed the pedal P is "60", so that the control value (N) corresponding to the input value "60" is output from the original conversion table. This can be said to b substantively equivalent to outputting the control value (N), corresponding to the input value "100", from "Updated Table 1", although the original conversion table is not actually updated.

EXAMPLE 2

Next, the pedal output conversion process is described in relation to a case when the pedal P is in the non-normal state ("Non-normal State A" in FIG. 5) with the spring B weakened. In this case too, the current detection value is set directly as the offset value (see step S3 of FIG. 3) in the initial execution of the pedal output conversion process. However, in this case, an offset value (e.g., "38") is set which is greater that an offset value set in the normal state. Once the pedal P is depressed by the user, a detection output value (e.g., "100") corresponding to a depressed angle of the pedal P is output from the pedal operation detection section 4. Thus, a difference between the detection output value "100" and the offset value "38" is calculated as "62" (i.e., 100−38=62). Then, the play value is added to the difference "62", so that a key value "52" is obtained (i.e., 62−10=52). On the basis of the key value "52", a control value is output with reference to the original conversion table (steps S12-S14 of FIG. 3).

In this non-normal state, even if the detection output value corresponding to the depressed angle is "100" identical to that in the normal state, the actual depressed amount of the pedal depressed by the user (human player) tends to be smaller than that in the normal state by an amount corresponding to weakening of the spring B (because a greater offset value is set in the non-normal state), so that a control value (O) corresponding to the input value "52" is output from the original conversion table. This is substantively equivalent to a case where a detection output value corresponding to the one dead zone consisting of the offset value and the play value takes a value "48" (i.e., 38+10=48) and a control value corresponding to an amount through which the user has actually depressed the pedal P is determined using the detection output value "48" as a reference (i.e., a minimum value of the effective range) (see "Updated Table 2" of FIG. 4). Thus, even if the detection output value corresponding to the depressed angle is "100" that is identical to that in the normal state, the detection output value corresponding to the amount (angle) through which the user has actually depressed the pedal P is "52", so that the control value (O) corresponding to the input value "52" is output from the original conversion table.

EXAMPLE 3

The pedal output conversion process is described in relation to a case where the pedal P is in the non-normal state ("Non-normal State B" in FIG. 5) with the felt B deteriorated. In this case too, the current detection value is set directly as the offset value (see step S3 of FIG. 3) in the initial execution of the pedal output conversion process.

However, in this case, an offset value (e.g., "25") is set which is smaller that an offset value set in the normal state. Once the pedal P is depressed by the user, a detection output value (e.g., "100") corresponding to a depressed angle of the pedal P is output from the pedal operation detection section 4. Thus, a difference between the detection output value "100" and the offset value "25" is calculated as "75" (i.e., 100−25=75). Then, the play value is added to the difference "75", so that a key value "65" is obtained (i.e., 75−10=65). On the basis of the key value "65", a control value is output with reference to the original conversion table (steps S12-S14 of FIG. 3).

In this non-normal state, even if the detection output value corresponding to the depressed angle is "100" that is identical to that in the normal state, the actual depressed amount of the pedal depressed by the user tends to be larger than that in the normal state by an amount corresponding to deterioration of the felt F, so that a control value (M) corresponding to the input value "65" is output from the original conversion table. This is substantively equivalent to a case where a detection output value corresponding to the one dead zone that consists of the offset value and the play value takes a value "35" (i.e., 25+10=35) and a control value corresponding to an amount through which the user has actually depressed the pedal P is determined using the detection output value "35" as a reference (i.e., a minimum value of the effective range) (see "Updated Table 3" of FIG. 4). Thus, even if the detection output value corresponding to the depressed angle is "100" that is identical to that in the normal state, the detection output value corresponding to the amount (angle) through which the user has actually depressed the pedal P is "65", so that the control value (M) corresponding to the input value "65" is output from the original conversion table.

In each of the above-described cases, even when the depressed pedal P is further depressed or loosened, a detection output value corresponding to the further depression or loosening does not decrease below the offset value (step S4 of FIG. 3), so that the offset value is not updated (step S7 of FIG. 3). Namely, a control value is determined in response to depression of the pedal P on the basis of the changed reference (i.e., a minimum value of the effective range) without the reference being changed again (steps S12-S14).

Figure 4:
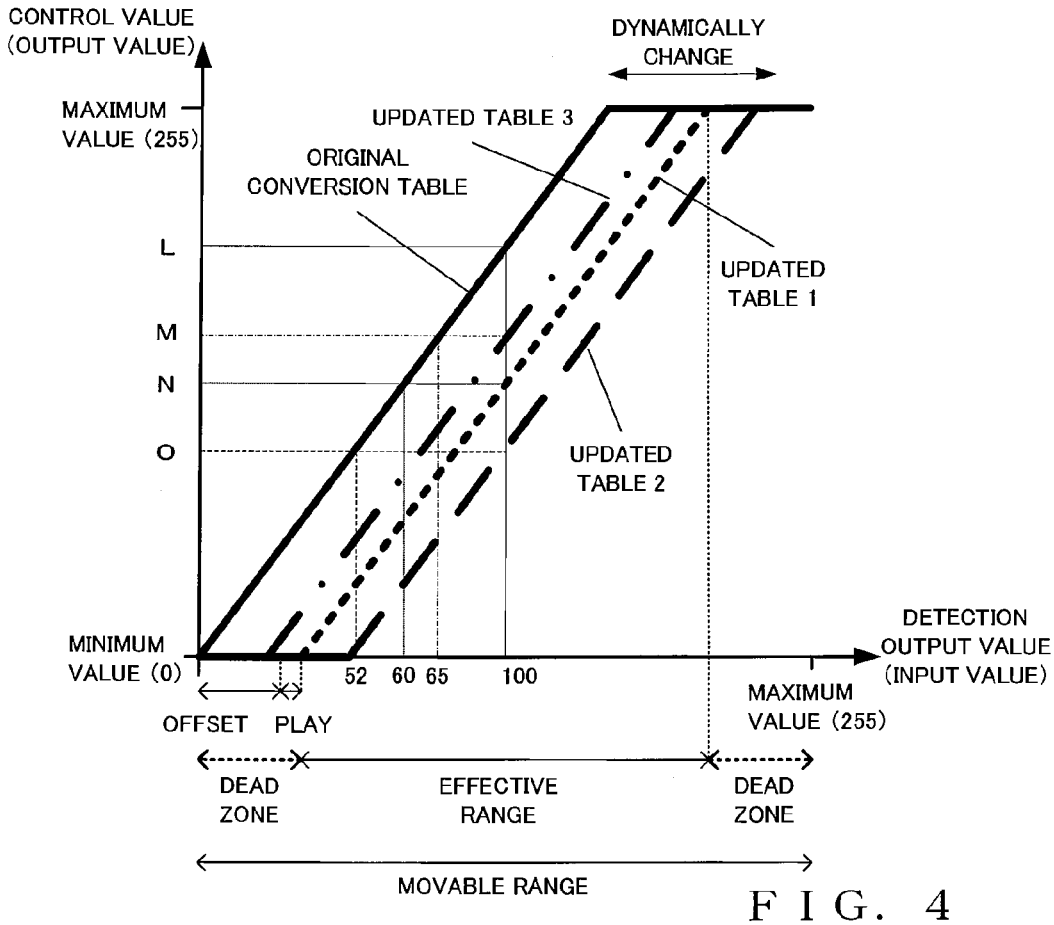
FIG. 4 is a graph showing an example of control values to be output in response to execution of the pedal output conversion process.

As set forth above, the scheme for determining a control value in the aforementioned "pedal output conversion process" is substantively equivalent to determining a control value in accordance with a virtual table (i.e., any one of Updated Table 1 to Updated Table 3) provided by dynamically changing the existing or prestored conversion table of FIG. 4 by an amount corresponding to the offset value. Namely, in the above-described embodiment, a process substantively equivalent to determining a control value on the basis of a table (any one of Updated Table 1 to Updated Table 3) provided by updating the minimum value (reference) of the effective range, outputting the minimum control value "0", in the prestored conversion table is achieved by constantly monitoring the pedal P during operation of the electronic musical instrument, changing the offset value in accordance with a state of the pedal P and determining an input value on the basis of the offset value and a detection output value, and referencing the prestored conversion table in accordance with the determined input value instead of the detection output value. Note that, according to the control value determining scheme employed in the instant embodiment, the same width of the effective range and shape (such as an inclination) of the graph as in the prestored conversion table are used in each of Updated Table 1 to Updated Table 3. In a lower end section of the graph of FIG. 4 are shown, for reference purposes, the dead zones (one of which consists of the offset value and the play value as set forth above) and the effective range within the movable range of the pedal P.

In the embodiment of the pedal output conversion apparatus of the invention, as set forth above, the pedal P is constantly monitored during operation of the electronic musical instrument, and a control value is determined by referencing the prestored conversion table with an input value that is determined on the basis of an offset value changed dynamically in accordance with a current state of the monitored pedal P and a current depressed angle of the pedal P. Namely, the instant embodiment determines a detection output value (input value) which corresponds to a depressed amount through which the user has actually depressed the pedal P, and then determines a control value by referencing the pre-stored conversion value in accordance with the determined detection output value (input value). Thus, the instant embodiment can output the control value with undesired variation or unevenness, which may have occurred due to an individual difference, aging, etc. of the pedal P, automatically appropriately compensated for. As a result, tone control responsive to user's depression of the pedal can be performed appropriately, with any pedal, with an always constant operational feeling (pedal pressing amount), and without being adversely influenced by the individual difference, aging, etc. of the pedal P.

Further, because only one conversion table (see FIG. 2) need to be provided per type of tone control parameter, the instant embodiment can advantageously reduce a necessary storage area. Further, another advantage of the instant embodiment is that the above-described pedal output control process requires only simple calculations and thus can reduce a necessary processing load.

Further, even when an inconvenience has occurred to the pedal operator unit U during a performance, the instant embodiment can continue to perform tone control by appropriately dealing with the inconvenience without requiring the user to stop the performance; thus, the user does not have to consciously perform particular operation, other than the performance operation, for removing the inconvenience.

Further, in the above-described embodiment of the pedal output conversion apparatus of the invention, the pedal may continue to heavily vibrate, without being stopped by the stopper, by quickly returning via the biasing force of the spring. In such a case, so-called "undershoot" can occur by the pedal greatly shaking in a negative direction so that abnormally small detection output values may be output, and thus, there is a possibility that an offset value unnaturally small for actual use will be undesirably set. Furthermore, if the pedal P is already in the depressed position or state at the time of powering-on of the electronic musical instrument, it is possible that the control value will not be output in a normal manner. Thus, the following describe given about how the present invention addresses these possible problems.

Case 4:

Consider a case where the pedal P is in an unstably vibrating (chattering) state that may cause undershoot. The "chattering" may be substantively described as a phenomenon where deterioration of the felt F and weakening of the spring B instantaneously repeat alternately, i.e. where Non-normal State A and Non-normal State B of FIG. 5 repeat alternately. Thus, in the "pedal output conversion process" of the instant embodiment, the operations of steps S5 to S9 are arranged to prevent abnormal control value generation at the time of occurrence of undershoot due to chattering of the pedal P. Namely, many detection output values smaller than the offset value (step S4 of FIG. 3) are stored into the output storage buffer with the passage of time (step S5 of FIG. 3), and the offset value is updated with the greatest of the thus-stored detection output values (step S7 of FIG. 3). Such operations permit recognition of how the vibrations of the chattering pedal P decrease with the passage of time, and, once the chattering stops, the pedal output conversion process of the instant embodiment appropriately sets an offset value suiting the stabilized state of the pedal P. Further, the pedal output conversion process constantly outputs a control value "0" during occurrence of the chattering (step S9 of FIG. 3) so as not to influence a tone to be generated.

Note that the above-described embodiment is constructed in such a manner that, in the unstably vibrating (chattering) state that may cause undershoot, the process updates the offset value with the greatest (i.e., smallest in the negative direction) of a predetermined number of detection output values smaller than the currently-set offset value. Alternatively, the process of the instant embodiment may calculate an average value of a plurality of previously-output detection output values, irrespective of whether or not the detection output values are smaller than the offset value, and update the offset value with the average value if the average value has decreased below the currently-set offset value.

Case 5:

The pedal output conversion process is described in relation to a case where the pedal P is already in the depressed state at the time of powering-on of the electronic musical instrument; to simplify the description, it is assumed here that the pedal P is in the normal state. In the initial execution of the pedal output conversion process, a current detection output value is set directly as an offset value (step S3 of FIG. 3); however, in this case, an extremely great offset value (e.g., "80") as compared to that in the non-depressed state of the pedal P is set. As the pedal P is released and returned from the depressed position to the non-depressed state, the detection output value may decrease below the offset value (step 4 of FIG. 3). Because the offset value is updated during that time (step S7), the offset value is set at "30" as in Case 1 above when the pedal P has returned to the non-depressed state. Note that, because the control value "0" is always output (step S9) while the offset value is being updated with a foot of the user released from the pedal (i.e., during returning movement of the pedal P), a tone to be generated is not influenced by the control value.

If the pedal P, which is already in the depressed state at the time of powering-on of the electronic musical instrument, is further depressed from the depressed position, then a detection output value (i.e. "100" greater than that output at the time of powering-on of the electronic musical instrument), so that a difference between the detection output value and the offset value is calculated as "20" (step S11). The key value is added to the difference to provide a key value "10" (i.e., 20−10=10), and a control value is output by referencing the conversion table on the basis of the key value (steps S12-S14). Namely, when the user continues to depress the pedal P without releasing the foot from the pedal P at all, a control value greatly different from an actual depressed angle would be output; however, once the user releases the foot from the pedal P, the control value will be restored to a value like that output in the non-depressed state of the pedal P. Namely, once the user releases the foot from the pedal P, the offset value is updated to "30" (step S7), and then a control value is output on the basis of the thus-updated offset value; therefore, tone control can be performed with no problem.

Further, whereas the embodiment of the present invention has been described as constructed to determine a control value by referencing the prestored conversion table using a key value determined on the basis of the offset value (see steps S11-S14 of FIG. 3), the present invention is not so limited. For example, an updated table may be newly created by updating the prestored conversion table on the basis of the offset value, and the thus-created updated table may be stored into the RAM 3; in this case, of course, a control value is determined by referencing the updated table in accordance with a detection output value itself.

Furthermore, whereas the embodiment has been described in relation to the case where the control value increases (from the minimum value "0" toward the maximum value "255") as the depressed angle of the pedal P becomes greater, the present invention is not so limited. For example, the embodiment may be constructed to decrease the control value as the depressed angle of the pedal P becomes greater (from the maximum value "255" toward the minimum value "0"). In such a case, updating of the offset value is carried out when the detection output value is not equal to or smaller than the offset value; namely, the determination criterion at step S4 is changed to "whether the detection output value is equal to or smaller than the offset value".

The scheme for estimating, on the basis of a state of a detection output value from the sensor K provided for detecting an operating position of the pedal P, that the pedal is in the non-depressed position and then updating the offset value with the detection output value when the pedal is in the non-depressed position is not limited to the aforementioned and may be replaced with any desired scheme.

Figure 3:
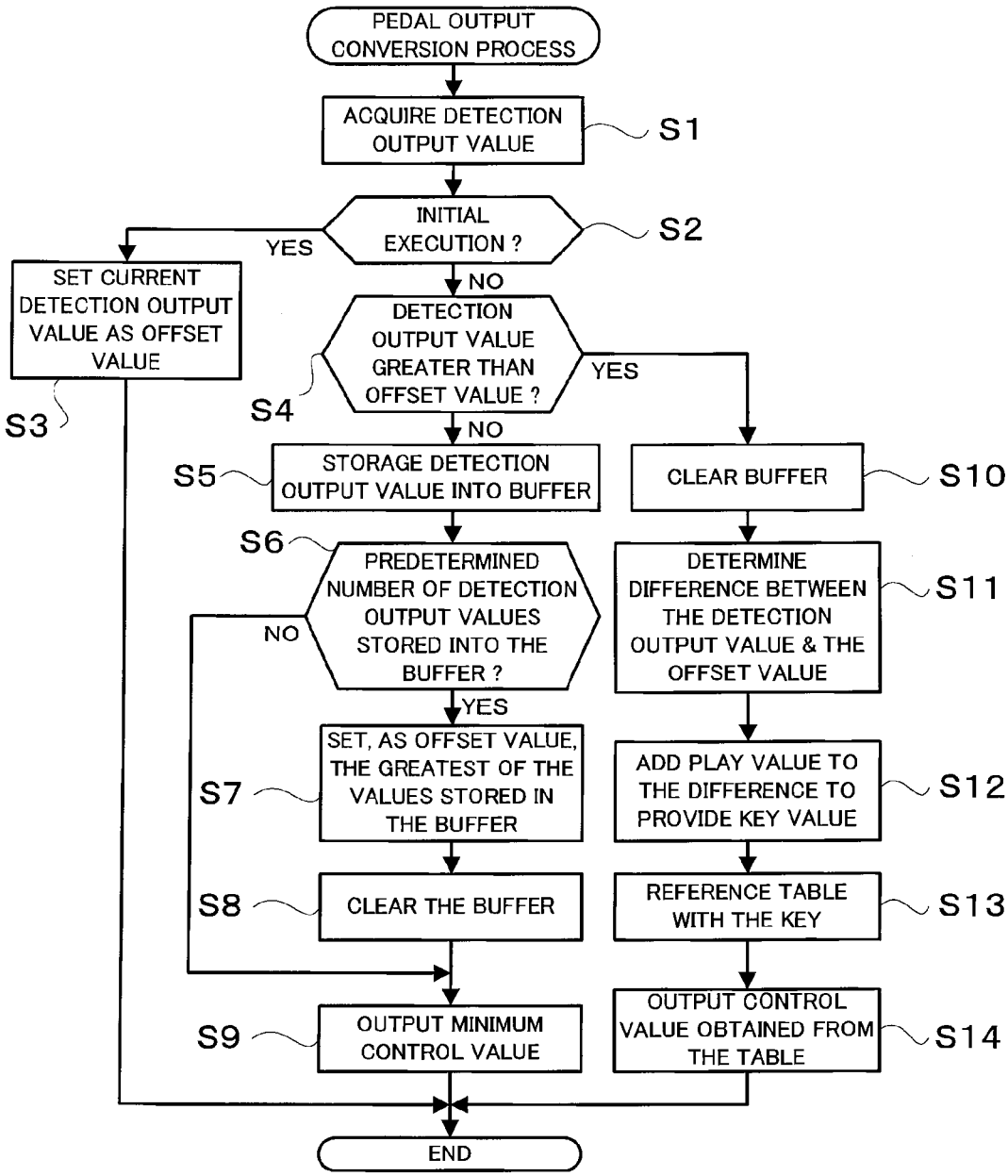
FIG. 3 is a flow chart showing an example operational sequence of a pedal output conversion process performed in the embodiment.

For example, the offset value may be initialized at the maximum value "255" of the movable range (detectable range) or at another suitable, relatively great value at step S3 of FIG. 3, and then, the offset value may be updated as necessary in accordance with a detection output value smaller than the current offset value in a similar manner to the above-described embodiment Even where the offset value is initialized (or provisionally set) at the maximum value "255" (or at another suitable, relatively great value), the offset value is soon updated appropriately in accordance with a detection output value generated when the pedal is in the non-depressed state; thus, a detection output value corresponding to the non-depressed state of the pedal can be set as the offset value without involving any problem As another example, when the pedal P is in the non-depressed state may be detected via a switch, and a detection output value from the sensor K may be set/updated as the offset value in response to the detection signal of that switch.

The present application is based on, and claims priority to, Japanese Patent Application No. 2009-003796 filed on Jan. 9, 2009. The disclosure of the priority application, in its entirety, including the drawings, claims, and the specification thereof, is incorporated herein by reference.

What is claimed is:

1. A pedal output conversion apparatus for a pedal having a sensor that detects a depression position of the pedal, the apparatus comprising:

an input section which inputs a detection output value based on an output of the sensor;

an offset value setting section which sets, as an offset value, a detection output value corresponding to a non-depressed state of the pedal output by the sensor;

an adjustment section which adjusts the detection output value, input via said input section, with the offset value to provide an adjusted detection output value corresponding to an actual depressed amount of the pedal; and a conversion section which converts the adjusted detection output value into a control value corresponding to the depressed amount of the pedal.

2. The pedal output conversion apparatus as claimed in claim 1, wherein said conversion section includes a conversion table for converting a detection output value to a control value and provides a control value corresponding to a depressed amount of the pedal by referencing the conversion table in accordance with the adjusted detection output value.

3. The pedal output conversion apparatus as claimed in claim 2, wherein:

said offset value setting section updates, as necessary, the offset value in accordance with the detection output value corresponding to the non-depressed state of the pedal, said conversion table is an original conversion table, and said conversion section adjusts the detection output value, input via said input section, in accordance with the offset value updated as necessary and provides a control value corresponding to a depressed amount of the pedal by referencing the original conversion table in accordance with the adjusted detection output value.

4. The pedal output conversion apparatus as claimed in claim 1, wherein the control value is a value for controlling a factor of a tone.

5. The pedal output conversion apparatus as claimed in claim 1, wherein said offset value setting section initializes the offset value to a predetermined initial value, and when a depressed amount corresponding to a depressed position of the pedal indicated by the detection output value input via said input section is smaller than a depressed amount corresponding to a depressed position of the pedal indicated by a current offset value, said offset value setting section updates the offset value with the detection output value input via said input section.

6. The pedal output conversion apparatus as claimed in claim 5, wherein the predetermined initial value is the detection output value input via said input section upon powering-on.

7. The pedal output conversion apparatus as claimed in claim 5, wherein the predetermined initial value is a greatest value of the detection output value.

8. The pedal output conversion apparatus as claimed in claim 1, wherein, on the basis of a plurality of the detection output values sampled successively in correspondence with the non-depressed state of the pedal, said offset value setting section identifies one detection output value having removed therefrom a component of chattering or minute vibrations caused during an OFF state of the pedal and updates the offset value with the identified detection output value.

9. The pedal output conversion apparatus as claimed in claim 1, wherein the pedal is normally biased in one direction by a spring in such a manner that the pedal is displaced from an original rest position, in response to user's operation of the pedal, in an opposite direction from the one direction against a biasing force of the spring, and that, when the user's operation of the pedal is canceled, the pedal returns to the original rest position by the biasing force of the spring.

10. A computer-implemented method for converting a pedal output from a pedal having a sensor that detects a depression position of the pedal, the method comprising:

an input step of inputting a detection output value based on an output of the sensor;

a step of setting, as an offset value, a detection output value corresponding to a non-depressed state of the pedal output by the sensor;

a step of adjusting the detection output value, input via said input step, in accordance with the offset value to provide an adjusted detection output value corresponding to an actual depressed amount of the pedal; and a step of converting the adjusted detection output value into a control value corresponding to the depressed amount of the pedal.

11. A non-transitory computer-readable storage medium storing a program executable by a computer to perform a pedal output conversion method for a pedal having a sensor that detects a depression position of the pedal, the method comprising:

an input step of inputting a detection output value based on an output of the sensor;

a step of setting, as an offset value, a detection output value corresponding to a non-depressed state of the pedal output by the sensor;

a step of adjusting the detection output value, input via said input step, in accordance with the offset value to provide an adjusted detection output value corresponding to an actual depressed amount of the pedal; and a step of converting the adjusted detection output value into a control value corresponding to the depressed amount of the pedal.

* * * * *